US005649777A

United States Patent [19]

Holloway

[11] Patent Number: 5,649,777

[45] Date of Patent: Jul. 22, 1997

[54] COSMETIC DISPENSER WITH LOCKING CUP REPLACEABLE CARTRIDGE

[75] Inventor: Thomas F. Holloway, Southbury, Conn.

[73] Assignee: Risdon Corporation, Naugatuck, Conn.

[21] Appl. No.: 336,376

[22] Filed: Nov. 8, 1994

[51] Int. Cl.[6] ..... A45D 40/06

[52] U.S. Cl. ..... 401/78; 401/74; 401/86

[58] Field of Search ..... 401/78, 74, 86

[56] References Cited

U.S. PATENT DOCUMENTS

| | | | |
|---|---|---|---|
| 3,146,881 | 9/1964 | Metreaud et al. | 206/56 |
| 3,323,641 | 6/1967 | Landen | 206/56 |
| 3,515,493 | 6/1970 | Gruska | 401/78 X |
| 3,758,218 | 9/1973 | Pfrommer et al. | 401/86 |
| 4,505,607 | 3/1985 | Sugiyama | 401/78 |
| 4,666,324 | 5/1987 | Oses | 401/131 |
| 4,812,066 | 3/1989 | Gueret | 401/78 |
| 4,961,663 | 10/1990 | Twamoto et al. | 401/78 |
| 5,000,601 | 3/1991 | Wruck | 401/78 |
| 5,186,560 | 2/1993 | Holloway | 401/78 |
| 5,186,561 | 2/1993 | Ackermann et al. | 401/78 |
| 5,240,337 | 8/1993 | Gruner | 401/78 |
| 5,324,126 | 6/1994 | Holloway et al. | 401/78 |
| 5,340,225 | 8/1994 | Chevassus | 401/78 |
| 5,399,040 | 3/1995 | Holloway | 401/78 |

FOREIGN PATENT DOCUMENTS

| | | | |
|---|---|---|---|
| 672087 | 10/1963 | Canada . | |
| 2670998 | 7/1992 | France | 401/78 |
| 2245544 | 8/1992 | United Kingdom . | |

*Primary Examiner*—Steven A. Bratlie

*Attorney, Agent, or Firm*—St. Onge Steward Johnston & Reens

[57] ABSTRACT

A cosmetic preparation dispenser permits filling of a dispenser cartridge and retraction thereof, but is subsequently inoperable until assembly with a master case. The cartridge includes a cam sleeve, innerbody and elevator cup. The locking of the cartridge is obtained by lower leftwardly extending track segments at the lower end of innerbody longitudinal track segments, which trap and retain the elevator cup when it is retracted after the cartridge is filled with a cosmetic stick. When the cartridge is assembled with the master base, a stem in the master base pushes against the elevator cup to urge it out of it locked position to permit the elevator cup to be freely movable along the axial path.

21 Claims, 3 Drawing Sheets

COSMETIC DISPENSER WITH LOCKING CUP REPLACEABLE CARTRIDGE

FIELD OF THE INVENTION

The present invention relates to the field of cosmetic and lipstick dispensers and, especially, to those permitting refill of the dispenser by removal and insertion of a lipstick cartridge into a master case.

BACKGROUND OF THE INVENTION

Economic and environmental concerns are providing incentives to reduce the production and use of disposable packaging. In the field of cosmetic dispensers, the outer, or master case may be an expensive, aesthetically appealing case, or may be made or finished with precious materials, making it desirable to permit reuse of the case. However, there are competing concerns of hygiene and product damage that arise when a lipstick case is to be refilled. It is very important to the reputable manufacturer of cosmetics that the lipstick cartridge not be useable unless it is installed in a master case. This is desirable to prevent a consumer from using the cartridge without the case, a procedure likely to damage the cosmetic stick. A cartridge that locks a retracted cosmetic in place would also be desirable to minimize the possibility of damage to the stick during transport.

Conventional propel/repel lipstick dispensers typically have an outer helical track cam sleeve and a longitudinal track innerbody rotatable inside the cam sleeve to axially propel and retract an elevator cup with a lug or lugs that track in the cam track and in the longitudinal track. Relative rotation between the cam sleeve and the innerbody axially propels and retracts the elevator cup which holds a cosmetic stick.

It has been known to use a plug to fit into a bottom aperture of an innerbody to retain an annular weight to the dispenser, as shown in Oses, U.S. Pat. No. 4,666,324; and to use such a plug to retain a base to an innerbody, as disclosed in U.K. Patent Application GB 2245544. However, none of the known references teach a method of locking a retracted elevator cup within a cartridge, while providing an apparatus to automatically unlock the elevator cup when the cartridge is assembled to a base of a master case.

SUMMARY OF THE INVENTION

It is an object of the invention to provide an improved cosmetic preparation dispenser having a mechanism permitting filling of a dispenser cartridge and retraction thereof, but which is subsequently inoperable until assembly of the cartridge with a master case.

It is an object of the invention to provide such a cosmetic preparation dispenser that can be filled with a cosmetic and the cosmetic retracted without the use of special jigs or fixtures.

It is a further object of the invention to provide an improved cosmetic preparation dispenser that permits the master case to have any desired ornamental appearance.

In accordance with the present invention, a cosmetic dispenser includes a cartridge assembly and a base and plug assembly. The cartridge assembly includes a cam sleeve, innerbody and elevator cup. The cam sleeve is a conventional cam sleeve with a helical track. The innerbody has a conventional longitudinal track, but in addition also has a lower leftwardly extending track segment at its lower end. Preferably, the leftwardly extending track segments meets the longitudinal track at a sharp corner, most preferably, a ninety degree corner. The elevator cup is lockable in a retracted position by relative rotation of the innerbody and cam to retract the elevator cup until the elevator cup's cam follower lug tracks into and is trapped in the lower leftwardly extending track segment.

The base and plug assembly has an upwardly extending stem for fitting into an aperture in the lower end of the innerbody. The stem has resilient gripping lips for engaging the aperture. When the base and plug assembly is assembled with the cartridge, the stem pushes against the elevator cup when the elevator cup is in the retracted locked position to urge the elevator cup out of the retracted locked position to permit the elevator cup to be freely movable along the axial path. The plug is installed in the base, which is preferably an ornamental base of the master case, by gluing or friction fit.

Other objects, aspects and features of the present invention in addition to those mentioned above will be pointed out in or will be understood from the following detailed description provided in conjunction with the accompanying drawings.

DETAILED DESCRIPTION OF THE PREFERRED EMBODIMENT

Figure 1:
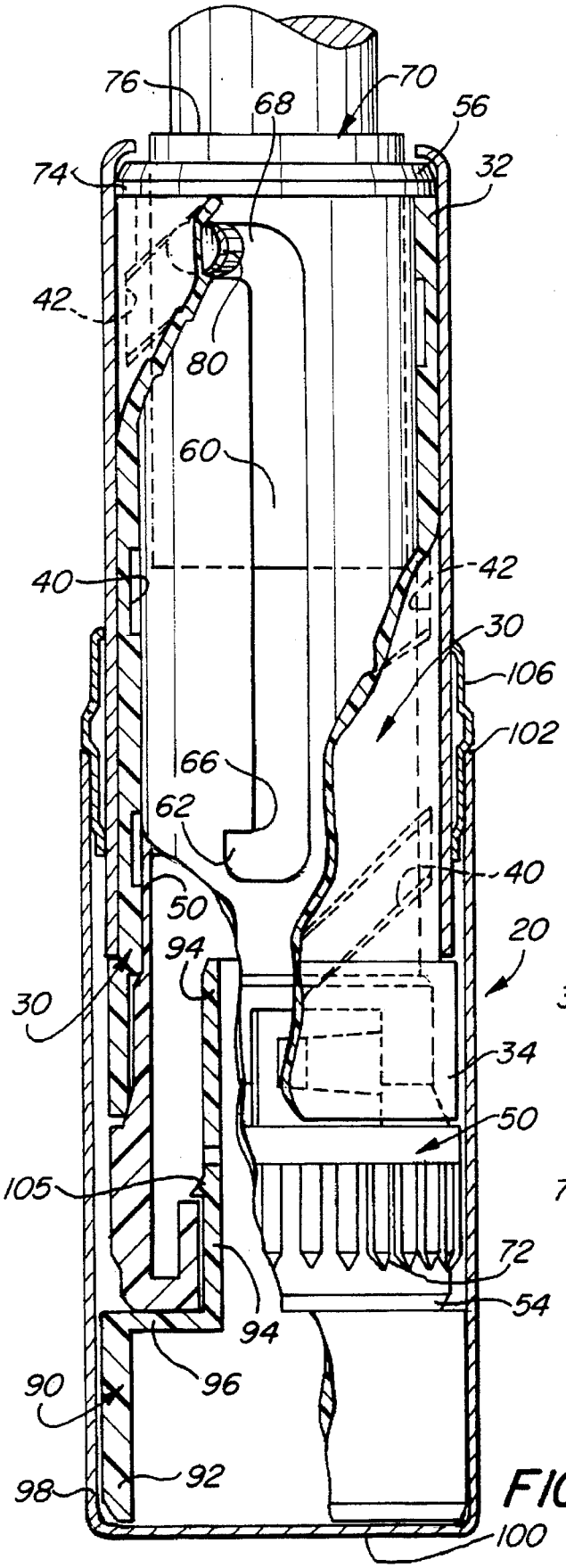
FIG. 1 is an elevation view with a partial cutaway of an embodiment of a cosmetic dispenser with a locking cup replaceable cartridge in accordance with the invention.
Figure 3:
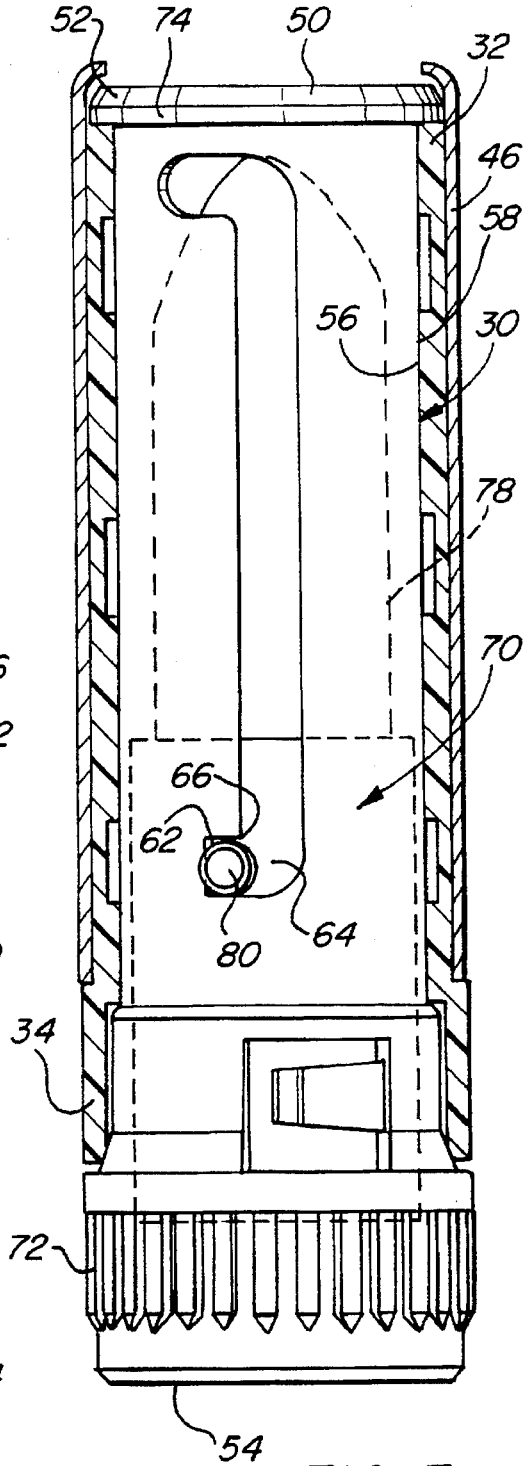
FIG. 3 is an elevation view with partial cutaway showing an embodiment of a cartridge in accordance with the invention with its elevator cup in a retracted locked position.
Figure 2:
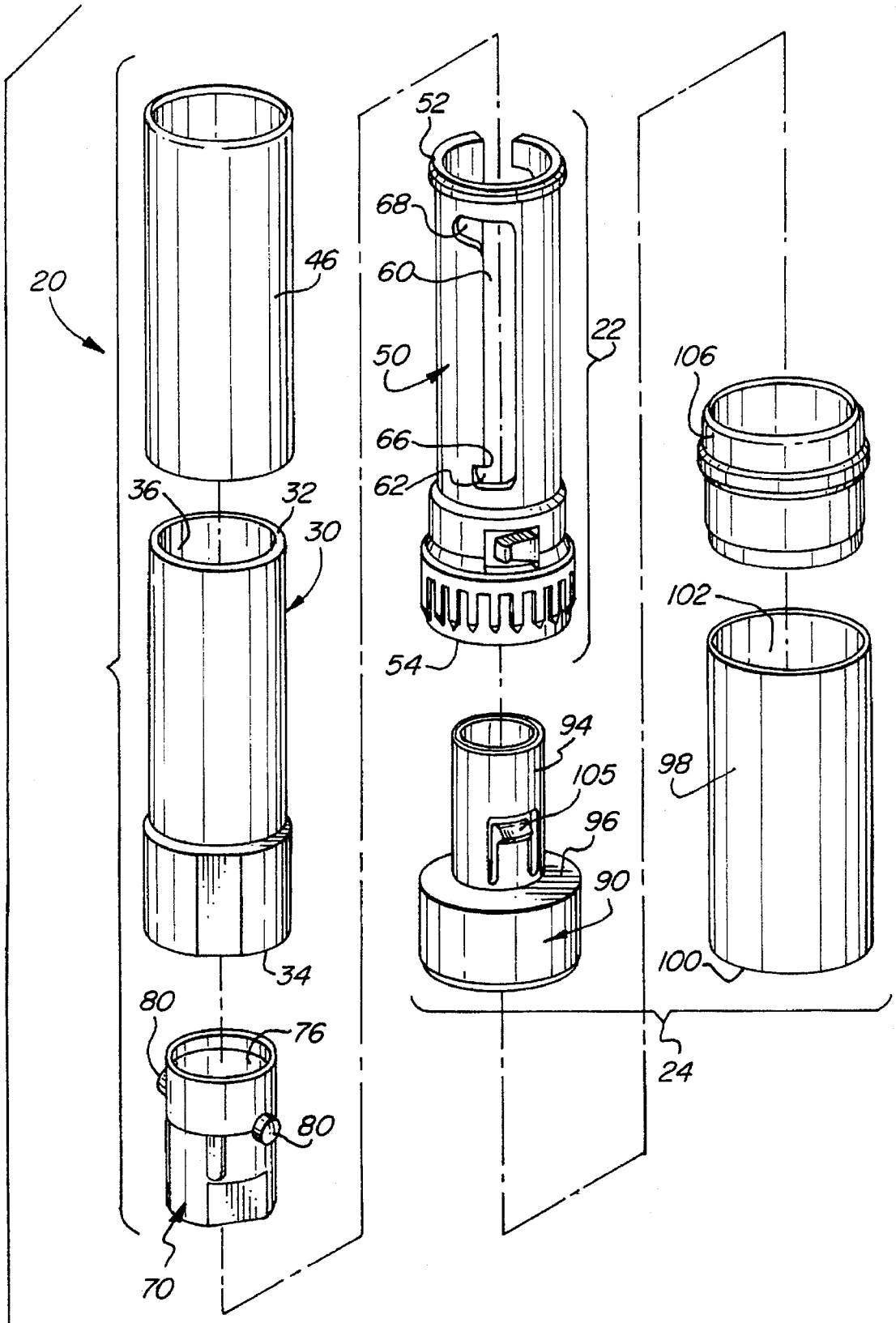
FIG. 2 is an exploded view of the dispenser of FIG. 1.
Figure 4:
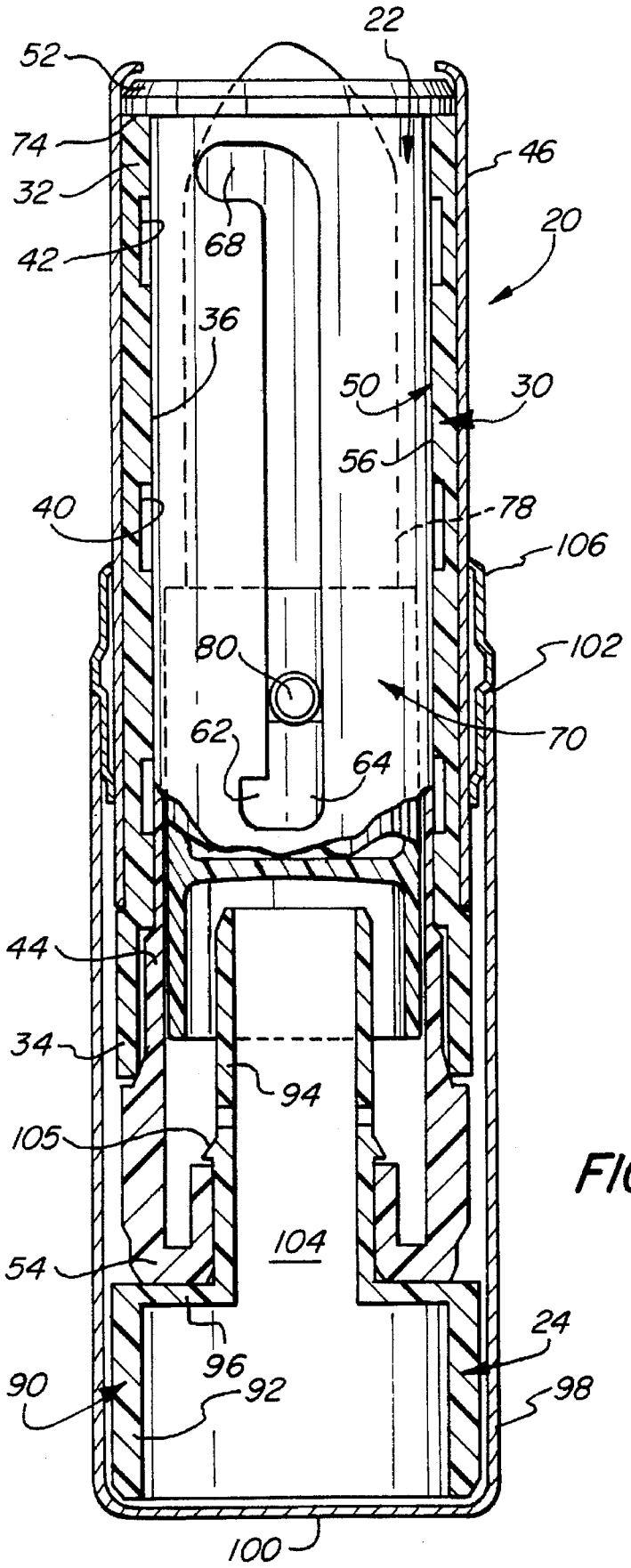
FIG. 4 is an elevation view with partial cutaway showing the assembly of an embodiment of a plug and base together with the cartridge of FIG. 3 and the unlocking of the elevator cup from its retracted locked position.

Referring now to FIGS. 1–4, where like elements are identified by like numbers in the drawings, an improved cosmetic dispenser with a locking cup replaceable cartridge is shown generally at 20. Dispenser 20 comprises a cartridge assembly 22 and a plug and base assembly 24.

Cartridge assembly 22 comprises a cam sleeve 30, an innerbody 50, and an elevator cup 70.

Cam sleeve 30 is rigid and tubular and has an upper end 32 and a lower end 34. Cam sleeve 30 has an inner wall 36 and an outer wall 38. At least one and preferably two internal helical tracks 40 and 42 are formed on the inner wall 36. Helical tracks 40 and 42 are located 180 degrees apart and extend along a substantial length of the inner wall 36 of the cam sleeve 30. Preferably, each helical track 40 and 42 provides one 360 degree circle in the inner wall 36 of cam sleeve 30. Cam sleeve 30 has a smooth inner wall 44 at its base 34. An ornamental outer shell 46 such as a brass tube may be fitted over the outer wall 38 of the cam sleeve for decoration.

Innerbody 50 is also tubular and has an upper end 52 and a lower end 54. Innerbody 50 has an inner wall 56 and an outer wall 58. Innerbody 50 is fitted into the cam sleeve 30 and has at least one and preferably two longitudinal tracks 60 which extend along the axial length of the innerbody 50 and which extend through the walls 56 and 58 of the innerbody 50 along a substantial length of the innerbody 50.

A leftwardly extending lower track segment 62 extends laterally from the lower end 64 of each longitudinal track 60. Preferably, the leftwardly extending track segment 62 meets the longitudinal track 60 at a sharp corner 66, most preferably, a ninety degree corner. As further explained hereafter, the leftwardly extending track segment 62 permits locking of the elevator cup 70 in a retracted position after loading of a cosmetic stick into the cup 70. Preferably, the lower leftwardly extending track segments 62 are located at about the same level as the lower end of the helical tracks 40, 42.

Each longitudinal track 60 preferably has at its upper end an upper lateral track segment 68 which preferably extends perpendicularly from the longitudinal track 60. The upper lateral track segment 68 permits the elevator cup 70 to be locked in an extended position for filling with a cosmetic stick and locks it in the extended position during use by the consumer.

The innerbody 50 is interlocked with the cam sleeve 30 so that rotation or application of a swivel torque to the cam sleeve 30 relative to innerbody 50 can be accomplished by gripping an extended cylindrical knob portion 72 on innerbody 50 with one hand and cam sleeve 30 with the other hand to raise or lower elevator cup 70. The cam sleeve 30 and innerbody 50 are preferably secured together by a retaining lip 74 on the upper end 52 of innerbody 50 that retains the upper end 32 of cam sleeve 30 in place on innerbody 50. The knob portion 72 of innerbody 50 has a larger diameter than the lower end 34 of cam sleeve 30 and thereby holds the cam sleeve lower end 34 in place.

The elevator cup 70 is generally cylindrical and has a chamber 76 for containing a cosmetic preparation such as lipstick pomade 78. The cup 70 is fitted into the innerbody 50. Cup 70 has at least one and preferably two cam follower lugs 80 for seating in and following in the longitudinal tracks 60 of the innerbody 50 and the helical tracks 40 and 42 of the cam sleeve 30. The lugs 80 are located 180 degrees apart and have a sufficient length to extend through the longitudinal tracks 60 to engage the helical tracks 40 and 42. Cup 70 is movable in an axial path in a conventional manner by relative rotation of the innerbody 50 and cam sleeve 30 by virtue of the lugs 80 seating in the helical tracks 40 and 42 of cam sleeve 30 and the longitudinal tracks 60 of innerbody 50. The relative rotation of the cam sleeve 30 and innerbody 50 causes the cup 70 to move axially to propel the elevator cup 70 to an extended position, and relative rotation in the opposite direction causes the elevator cup 70 to retract to a retracted position. In the preferred embodiment, the helical tracks 40 and 42 are right hand threads in the cam sleeve 30 and have a thread pitch of about 30 degrees so that each makes one complete revolution as the cup 70 traverses the length of the dispenser 20. This is desirable as only a single turn is needed to fully activate the dispenser 20 or to fully retract the dispenser.

After loading of a cosmetic stick into the cup 70, the cup will be retracted by rotation of the cartridge elements until lugs 80 track to the bottom of the longitudinal track 60. The direction of rotation is then reversed, and the lugs 80 will move directly into the leftwardly extending track segments 62. At this point, the cup 70 is trapped in the retracted position. Efforts to advance the cup 70 will not be effective because the lugs 80 are trapped in a blind track.

Preferably, the dispenser 20 is provide with resilient flex tabs as disclosed in U.S. Pat. No. 5,186,560 (Feb. 16, 1993), U.S. Pat. No. 5,186,561 (Feb. 16, 1993), and U.S. Pat. No. 5,324,126 (Jun. 28, 1994), the disclosures of which are hereby incorporated by reference.

The plug and base assembly 24 includes a plug 90. Plug 90 preferably comprises a lower larger diameter tubular segment 92 and an upper smaller diameter tubular stem 94. The lower and upper segments 92, 94 are joined by a step segment 96 therebetween. Base 98 preferably comprises an ornamental base of a master case with plug 90 glued or frictionally mounted therein. Base 98 preferably has a closed lower end 100, and an open upper end 102 into which plug 90 is mounted.

During assembly of cartridge 22 with the plug and base assembly 24, the stem 94 will be fitted into an aperture 104 in the lower end 54 of the innerbody 50. The stem 94 has resilient gripping lips 105 for engaging the aperture 104. Gripping lips 105 are preferably formed with, and cutaway from stem 94. When the plug 90 is assembled with the cartridge 22, the stem 94 pushes against the retracted and locked elevator cup 70 to urge the elevator cup 70 out of the retracted locked position. The elevator cup 70 has an upper portion for holding a cosmetic stick, and a cup floor. The cup floor is located intermediate the upper and lower ends of the elevator cup 70 whereby the cup 70 has a lower portion open at its lower end. The stem 94 fits inside the cup lower portion and pushes against the cup floor to urge the cup out of the retracted locked position. When the base and assembly plug 24 is secured to the cartridge 22, the stem 94 thereafter prevents retraction of the cup 70 to the point where it can be trapped in the locked position, and the elevator cup 70 is thereafter freely movable along its axial path.

Ornamental base 98 contains within it not only plug 90, but also the lower portions of the interfitted innerbody 50 and cam sleeve 30. A collar 106 is fitted onto the upper end 102 of the ornamental base 98, and contains and holds the outer shell 46 fitted around cam sleeve 30.

The cam sleeve 30 and innerbody 50, and plug 90 are preferably formed by molding from a thermoplastic such as styrene. The elevator cup is preferably formed from acetal.

The present invention therefore provides a new and useful cosmetic dispenser with a replaceable cosmetic cartridge that prevents use of the cartridge until assembled with the master case. The present invention thus permits the cartridge 22 to be filled with a cosmetic stick, but the cartridge is not useable until assembly with the master case.

It is to be appreciated that the foregoing is illustrative and not limiting of the invention, and that various changes and modifications to the preferred embodiments described above will be apparent to those skilled in the art. Such changes and modifications can be made without departing from the spirit and scope of the present invention, and it is therefore intended that such changes and modifications be covered by the following claims.

What is claimed is:

1. A cosmetic dispenser, comprising:

a tubular cam sleeve having upper and lower ends and inner and outer walls and having an internal helical track extending along a substantial length of the inner wall of said cam sleeve;

a tubular innerbody having upper and lower ends, said innerbody being fitted into said tubular cam sleeve and being provided with a longitudinal track extending through the wall of said innerbody along a substantial length of said innerbody, said longitudinal track having an upper end and a lower end, said lower end of said longitudinal track having, in an elevation view, a lower leftwardly extending track segment;

a generally cylindrical elevator cup for containing a cosmetic preparation, fitted into said innerbody and having a cam follower lug extending through said longitudinal track to engage said helical track, said elevator cup being movable in an axial path by relative rotation of said innerbody and cam sleeve, and being lockable in a retracted position by relative rotation of said innerbody and cam sleeve to retract said elevator cup until said cam follower lug tracks into and is trapped in said lower leftwardly extending track segment; and a stem fitting into an aperture in said lower end of said innerbody, said stem extending upwardly to push against said elevator cup when said elevator cup is in a retracted locked position to urge said elevator cup out of said retracted locked position and to prevent said cam follower lug from tracking into and being trapped in said lower leftwardly extending track segment.

2. A cosmetic dispenser in accordance with claim 1, wherein said leftwardly extending track segment and said longitudinal track meet at a sharp cornered angle.

3. A cosmetic dispenser in accordance with claim 2, wherein said leftwardly extending track segment and said longitudinal track meet at a ninety degree angle.

4. A cosmetic dispenser in accordance with claim 2, further comprising an upper leftwardly extending track segment extending from an upper end of said longitudinal track of said innerbody.

5. A cosmetic dispenser in accordance with claim 2, wherein said stem further comprises resilient gripping lips for engaging said aperture in said lower end of said innerbody.

6. A cosmetic dispenser in accordance with claim 5, wherein said stem is part of a plug having a lower larger diameter tubular segment and said stem comprises an upper smaller diameter tubular segment, said lower and upper segments being joined by a step segment therebetween.

7. A cosmetic dispenser in accordance with claim 6 further comprising an ornamental base having a closed lower end and an open upper end, said base containing said plug and lower portions of said interfitted inner body and cam sleeve in said open upper end of said base.

8. A cosmetic dispenser in accordance with claim 7 further comprising a collar fitted onto said upper end of said ornamental base, and an outer shell fitted around said cam sleeve, said collar containing and holding said outer shell.

9. A cosmetic dispenser in accordance with claim 1, said lower leftwardly extending track segment being located at about the same level as a lower end of said helical track.

10. A cosmetic dispenser, comprising:

a tubular cam sleeve having upper and lower ends and inner and outer walls and having an internal helical track extending along a substantial length of the inner wall of said cam sleeve;

a tubular innerbody having upper and lower ends, said innerbody being fitted into said tubular cam sleeve and being provided with a longitudinal track extending through the wall of said innerbody along a substantial length of said innerbody, said longitudinal track having an upper end and a lower end, said lower end of said longitudinal track having, in an elevation view, a lower leftwardly extending track segment, said lower leftwardly extending track segment extending from said longitudinal track to form a sharp cornered angle, said lower leftwardly extending track segment being located at about the same level as a lower end of said helical track;

a generally cylindrical elevator cup for containing a cosmetic preparation, fitted into said innerbody and having a cam follower lug extending through said longitudinal track to engage said helical track, said elevator cup being movable in an axial path by relative rotation of said innerbody and cam sleeve, and being lockable in a retracted position by relative rotation of said innerbody and cam sleeve to retract said elevator cup until said cam follower lug tracks into and is trapped in said lower leftwardly extending track segment; and a plug having a lower larger diameter tubular segment and an upper smaller diameter tubular stem, said stem extending upwardly to fit into an aperture in said lower end of said innerbody, and push against said elevator cup when said elevator cup is in a retracted locked position to urge said elevator cup out of said retracted locked position to permit said elevator cup to be freely movable along said axial path.

11. A cosmetic dispenser in accordance with claim 10, further comprising resilient gripping lips provided on said stem for engaging said aperture.

12. A cosmetic dispenser in accordance with claim 10 further comprising an ornamental base having a closed lower end and an open upper end, said base containing said plug and lower portions of said interfitted inner body and cam sleeve in its open upper end.

13. A cosmetic dispenser in accordance with claim 12 further comprising a collar fitted onto said upper end of said ornamental base, and an outer shell fitted around said cam sleeve, said collar containing and holding said outer shell.

14. A cosmetic dispenser, comprising:

a cartridge having a tubular cam sleeve having upper and lower ends and inner and outer walls and having an internal helical track extending along a substantial length of the inner wall of said cam sleeve;

a tubular innerbody having upper and lower ends, said innerbody being fitted into said tubular cam sleeve and being provided with a longitudinal track extending through the wall of said innerbody along a substantial length of said innerbody, said longitudinal track having an upper end and a lower end, said lower end of said longitudinal track having, in an elevation view, a lower leftwardly extending locking track segment;

a generally cylindrical elevator cup for containing a cosmetic preparation, fitted into said innerbody and having a cam follower lug extending through said longitudinal track to engage said helical track, said elevator cup being movable in an axial path by relative rotation of said innerbody and cam sleeve, and being lockable in a retracted position by relative rotation of said innerbody and cam sleeve to retract said elevator cup until said cam follower lug tracks into and is trapped in said lower leftwardly extending track segment; and a master case assembly having a base having a closed lower end and an open upper end, said base open upper end receiving therein said lower end of said innerbody; and a stem extending upwardly from said base for fitting into an aperture in said lower end of said innerbody and to push against said elevator cup when said elevator cup is in a retracted locked position to urge said elevator cup out of said retracted locked position to permit said elevator cup to be freely movable along said axial path and to prevent said cam follower lug from tracking into and being trapped in said lower leftwardly extending track segment.

15. A cosmetic dispenser in accordance with claim 14, wherein said stem further comprises resilient gripping lips for engaging said aperture in said lower end of said innerbody.

16. A cosmetic dispenser in accordance with claim 15, wherein said stem is part of a plug having a lower larger diameter tubular segment and said stem comprises an upper smaller diameter tubular segment, said lower and upper segments being joined by a step segment therebetween, said step segment being located against said lower end of said innerbody.

17. A cosmetic dispenser in accordance with claim 16 wherein said base comprises an ornamental base, and said base contains in its open upper end said plug and lower portions of said interfitted inner body and cam sleeve.

18. A cosmetic dispenser in accordance with claim 17 further comprising a collar fitted onto said upper end of said base, and an outer shell fitted around said cam sleeve, said collar containing and holding said outer shell.

19. A cosmetic dispenser in accordance with claim 14, wherein said leftwardly extending track segment and said longitudinal track meet at a sharp cornered angle.

20. A cosmetic dispenser in accordance with claim 19, wherein said leftwardly extending track segment and said longitudinal track meet at a ninety degree angle.

21. A cosmetic dispenser in accordance with claim 19, said lower leftwardly extending track segment being located at about the same level as a lower end of said helical track.

* * * * *